US010422589B2

(12) United States Patent
Ishimori et al.

(10) Patent No.: US 10,422,589 B2
(45) Date of Patent: Sep. 24, 2019

(54) HEAT EXCHANGER TUBE

(71) Applicants: HINO MOTORS, LTD., Tokyo (JP); SANKYO RADIATOR CO., LTD., Saitama (JP)

(72) Inventors: Takashi Ishimori, Tokyo (JP); Amane Yamamoto, Saitama (JP); Akio Oosawa, Saitama (JP)

(73) Assignees: HINO MOTORS, LTD., Tokyo (JP); SANKYO RADIATOR CO., LTD., Saitama (JP)

( * ) Notice: Subject to any disclaimer, the term of this patent is extended or adjusted under 35 U.S.C. 154(b) by 539 days.

(21) Appl. No.: 14/343,271

(22) PCT Filed: Oct. 2, 2012

(86) PCT No.: PCT/JP2012/006287
§ 371 (c)(1),
(2) Date: Mar. 6, 2014

(87) PCT Pub. No.: WO2013/051233
PCT Pub. Date: Apr. 11, 2013

(65) Prior Publication Data

US 2014/0262165 A1 Sep. 18, 2014

(30) Foreign Application Priority Data

Oct. 5, 2011 (JP) ..... 2011-220778

(51) Int. Cl.
*F28F 1/08* (2006.01)
*F28F 1/40* (2006.01)
(Continued)

(52) U.S. Cl.
CPC ..... *F28F 1/40* (2013.01); *F02M 26/32* (2016.02); *F28F 1/06* (2013.01); *F28F 1/08* (2013.01);
(Continued)

(58) Field of Classification Search
CPC ..... F28F 1/025; F28F 1/06; F28F 1/08
(Continued)

(56) References Cited

U.S. PATENT DOCUMENTS 2,093,256 A * 9/1937 Still ..... F28F 1/06 165/152
3,119,446 A * 1/1964 Gerhart ..... F28F 1/08 165/133
(Continued)

FOREIGN PATENT DOCUMENTS

DE 102012217333 A1 * 3/2014 ..... F28F 3/044
EP 2365270 A1 * 9/2011 ..... F28D 9/04
(Continued)

OTHER PUBLICATIONS

International Search Report dated Nov. 6, 2012 in PCT/JP12/006287 Filed Oct. 2, 2012.
(Continued)

*Primary Examiner* — Allen J Flanigan
(74) *Attorney, Agent, or Firm* — Oblon, McClelland, Maier & Neustadt, L.L.P.

(57) ABSTRACT

A heat exchanger tube is constituted by a flat tube body 14 shaped like a plurality of cylindrical tubes arranged mutually proximally in a plane and connected together at mutually proximate portions of the tubes as communicating portions 13. Cylindrical portions 15 corresponding to the cylindrical tubes of the flat tube body 14 have inner peripheries formed with swirling-flow-forming protrusions 16 directed along spiral trajectories coaxial with central axes O of the cylindrical portions 15 so that the respective cylindrical portions 15 may have individual swirling flows of the exhaust gas 10.

3 Claims, 4 Drawing Sheets

(51) Int. Cl.

| | |
|---|---|
| ***F28F 1/06*** | (2006.01) |
| ***F28F 1/42*** | (2006.01) |
| ***F28F 13/12*** | (2006.01) |
| ***F02M 26/32*** | (2016.01) |
| *F28D 7/16* | (2006.01) |
| *F28D 21/00* | (2006.01) |

(52) U.S. Cl.
CPC ..... *F28F 1/426* (2013.01); *F28F 13/12* (2013.01); *F28D 7/1684* (2013.01); *F28D 21/0003* (2013.01)

(58) Field of Classification Search
USPC ..... 165/109.1, 177, 179
See application file for complete search history.

(56) References Cited

U.S. PATENT DOCUMENTS 3,584,682 A * 6/1971 Leedham et al. ..... B21D 53/02 165/164
4,274,186 A * 6/1981 Pringle ..... B21D 53/027 165/172
5,178,124 A 1/1993 Lu et al.
6,470,878 B1 10/2002 Brown et al.
6,488,079 B2 * 12/2002 Zifferer ..... F28F 1/06 165/133
8,122,856 B2 * 2/2012 Franke et al. ..... F22B 37/18 122/235.17
2002/0121361 A1 * 9/2002 Zifferer ..... F28F 1/06 165/133
2003/0102114 A1 * 6/2003 Gueguen ..... F28D 1/0391 165/164
2003/0111210 A1 * 6/2003 Tsujita et al. ..... F28D 7/1653 165/51
2006/0237178 A1 10/2006 Katoh et al.
2007/0023172 A1 2/2007 Obrist et al.
2007/0209788 A1 * 9/2007 Jing et al. ..... F28D 7/026 165/177
2009/0183862 A1 7/2009 Benezech et al.
2009/0250198 A1 10/2009 Li et al.
2011/0146594 A1 * 6/2011 Smelcer ..... F24H 1/287 122/18.3

FOREIGN PATENT DOCUMENTS

GB 1012898 A 12/1965
JP 2000 345925 12/2000
JP 2001 254649 9/2001
JP 2006 322698 11/2006
JP 2007 518053 7/2007
JP 2008 232142 10/2008
JP 2008 232600 10/2008
JP 2008232142 A * 10/2008
JP 2009 270755 11/2009
WO WO 2005/088219 A1 9/2005
WO 2008 029639 3/2008

OTHER PUBLICATIONS

Extended European Search Report dated Jun. 1, 2015 in Patent Application No. 12837673.8.

* cited by examiner

HEAT EXCHANGER TUBE

TECHNICAL FIELD

The present invention relates to a heat exchanger tube usable for a heat exchanger of, for example, an EGR cooler.

BACKGROUND ART

Conventionally known is an EGR device for recirculation of a part of exhaust gas from, for example, a vehicle engine to the engine to suppress generation of nitrogen oxides. Some EGR devices are equipped with, midway of an exhaust gas recirculation line to the engine, an EGR cooler for cooling of the exhaust gas since cooling the exhaust gas to be recirculated to the engine will drop a temperature of and reduce a volume of the exhaust gas to lower a combustion temperature in the engine without substantial decrease in output of the engine, thereby effectively suppressing generation of nitrogen oxides.

FIG. 1 is a sectional view showing an example of the EGR cooler in which reference numeral 1 denotes a cylindrical shell with axially opposite ends to which plates 2 are respectively fixed to close the ends of the shell 1. Penetratingly fixed to the respective plates 2 are opposite ends of a number of tubes 3 extending axially in the shell 1.

Cooling water inlet and outlet pipes 4 and 5A are attached from outside to the shell 1 near one and the other ends of the shell 1, respectively, so that cooling water 9 is fed through the inlet pipe 4 into the shell 1, flows outside of the tubes 3 and is discharged outside of the shell 1 through the outlet pipe 5.

The respective plates 2 have, on their sides away from the shell 1, bowl-shaped hoods 6 fixed to the plates 2 so as to enclose end surfaces of the plates 2. The one and the other hoods 6 provide central exhaust-gas inlet and outlet 7 and 8, respectively, so that exhaust gas 10 from the engine enters through the inlet 7 into the one hood 6, is cooled during passage through the number of tubes 3 by heat exchange with cooling water 9 flowing outside of the tubes 3 and is discharged into the other hood 6 and recirculated through the outlet 8 to the engine.

In the figure, reference numeral 11 denotes a bypass outlet pipe, arranged at a position diametrically opposed to the cooling water inlet pipe 4, through which a part of the cooling water 9 is withdrawn to prevent the cooling water 9 from stagnating at the position diametrically opposed to the cooling water inlet pipe 4.

Such conventional EGR cooler has poor heat exchange efficiency since the exhaust gas 10 may flow straight in the tubes 3 and insufficiently contact inner peripheries of the tubes 3. Thus, it has been proposed that inner peripheries of the tubes 3 are formed with spiral protrusions 12 (the tubes 3 are concaved into spiral grooves on outer peripheries thereof to thereby provide the spiral protrusions 12 as inverse formations on the inner peripheries) to causes the exhaust gas 10 flowing through the tubes 3 to whirl, thereby increasing contact frequency and contact distance of the exhaust gas 10 to the inner peripheries of the tubes 3 to enhance the heat exchange efficiency of the EGR cooler (see, for example, Patent Literatures 1 and 2).

As prior art literatures pertinent to the invention, there already exist, for example, the following Patent Literatures 1 and 2.

CITATION LIST

Patent Literature

[Patent Literature 1] JP 2000-345925A
[Patent Literature 2] JP 2001-254649A

SUMMARY OF INVENTION

Technical Problems

In order to comply with further possible tightening of exhaust gas regulation in future, it has been demanded to increase, more than ever, an amount of the exhaust gas 10 to be recirculated to enhance an EGR ratio. However, in the above-mentioned structure with tubes 3 arranged in parallel with one another and accommodated in the shell 1, heat quantity exchanged per unit volume is so little that the EGR cooler as a whole becomes extremely large-sized, disadvantageously resulting in hardness in mounting of the same to a vehicle.

Thus, as shown in FIG. 3, flattening of the tube 3 is devised so as to enhance heat quantity exchanged per unit volume, which is however found out to have extremely lowered effect of causing the exhaust gas 10 to swirl by the spiral protrusions 12, adversely resulting in deteriorated heat exchange performance.

The invention was made in view of the above and has its object to provide a heat exchanger tube which can cause exhaust gas to swirl to thereby realize high heat exchange efficiency competing to the prior art and can substantially enhance heat quantity exchanged per unit volume to an extent unattainable in the prior art.

Solution to Problems

The invention is directed to a heat exchanger tube, characterized in that it comprises a flat tube body shaped like a plurality of cylindrical tubes arranged mutually proximately in a plane and connected together at mutually proximate portions thereof as communicating portions, cylindrical portions corresponding to said cylindrical tubes of said flat tube body having inner peripheries formed with swirling-flow-forming protrusions along spiral trajectories coaxial with central axes of said cylindrical portions so that swirling flows of heat medium may be individually formed in said respective cylindrical portions.

With the heat exchanger tube being thus constituted, the flows of the heat medium through the respective cylindrical portions of the flat tube body are guided in directions along the spiral trajectories by the swirling-flow-forming protrusions on the inner peripheries of said respective cylindrical portions, so that the swirling flows of the heat medium are individually formed in the respective cylindrical portions. As a result, contact frequency and contact distance of the heat medium to the inner peripheries of said respective cylindrical portions are increased to enhance the heat exchange efficiency. Moreover, the fact that the respective cylindrical portions are mutually in communication through the communicating portions ensures a sufficient flow-path cross-sectional area for passage of the heat medium, so that heat quantity exchanged per unit volume is enhanced and pressure loss is decreased.

It is preferable in the invention that neighboring cylindrical portions are shaped to have the swirling-flow-forming protrusions directed along mutually reversed spiral trajectories, which makes the swirling flows, at the communicating portions of the neighboring cylindrical portions, orientated in one and the same direction and mutually accelerated, so that, despite of the communication portions between the cylindrical portions, formation as swirling flows of the heat medium can be further ensured.

Advantageous Effects of Invention

According to the above-mentioned heat exchanger tube of the invention, various excellent effects can be obtained as mentioned below.

(I) While the heat medium is caused to swirl to thereby realize high heat exchange efficiency competing to the prior art, heat quantity exchanged per unit volume can be substantially enhanced to an extent unattainable in the prior art. In an application to a heat exchanger of, for example, an EGR cooler, the heat exchanger as a whole can be made compact in size to enhance mountability to, for example, a vehicle.

(II) When neighboring cylindrical portions are shaped to have the swirling-flow-forming protrusions directed along mutually reversed spiral trajectories, the swirling flows at the communicating portions of the neighboring cylindrical portions can be orientated in one and the same direction and mutually accelerated, which further ensures formation of the swirling flows in the respective cylindrical portions.

DESCRIPTION OF EMBODIMENT

An embodiment of the invention will be described in conjunction with the drawings.

Figure 1:
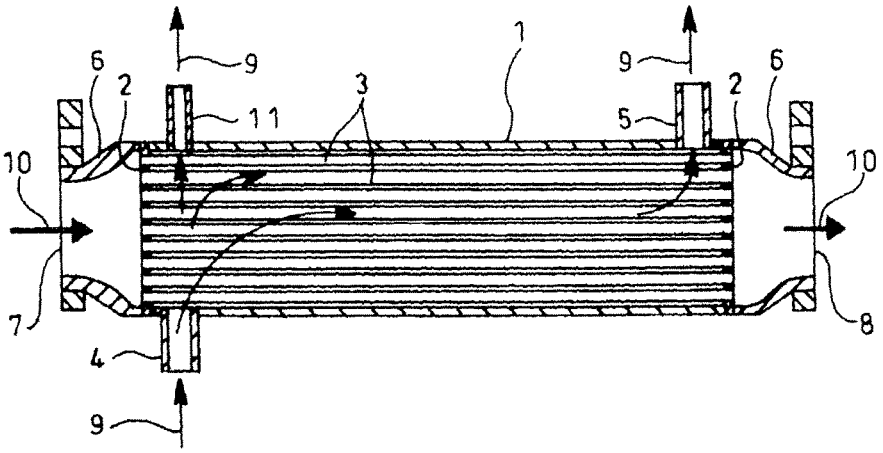
FIG.1 (Background Art)
FIG. 1 is a sectional view showing an example of a usual EGR cooler.
Figure 2:
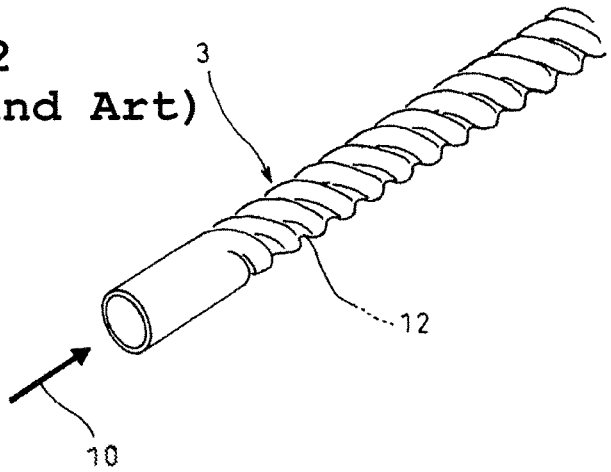
FIG.2 (Background Art)
FIG. 2 is a perspective view showing a conventional example.
Figure 3:
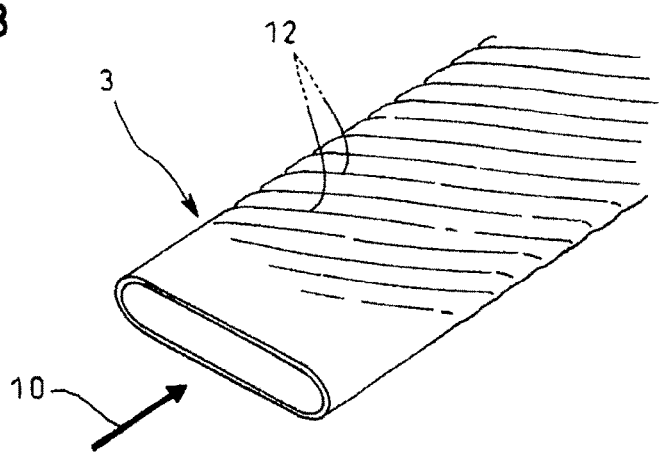
(Background Art) FIG. 3
FIG. 3 is a perspective view showing a trial model with the tube of FIG. 2 being flattened.
Figure 4:
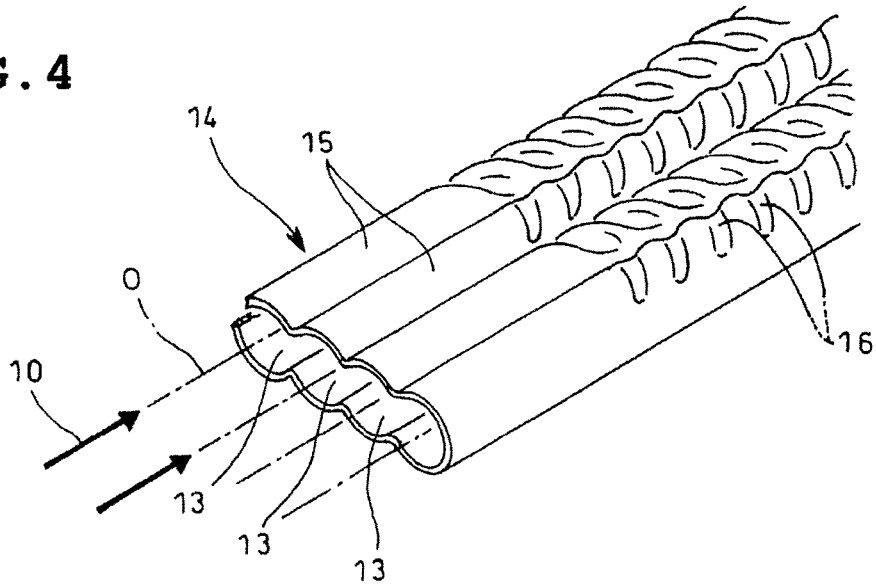
FIG. 4 is a perspective view showing an embodiment of the invention.
Figure 5:
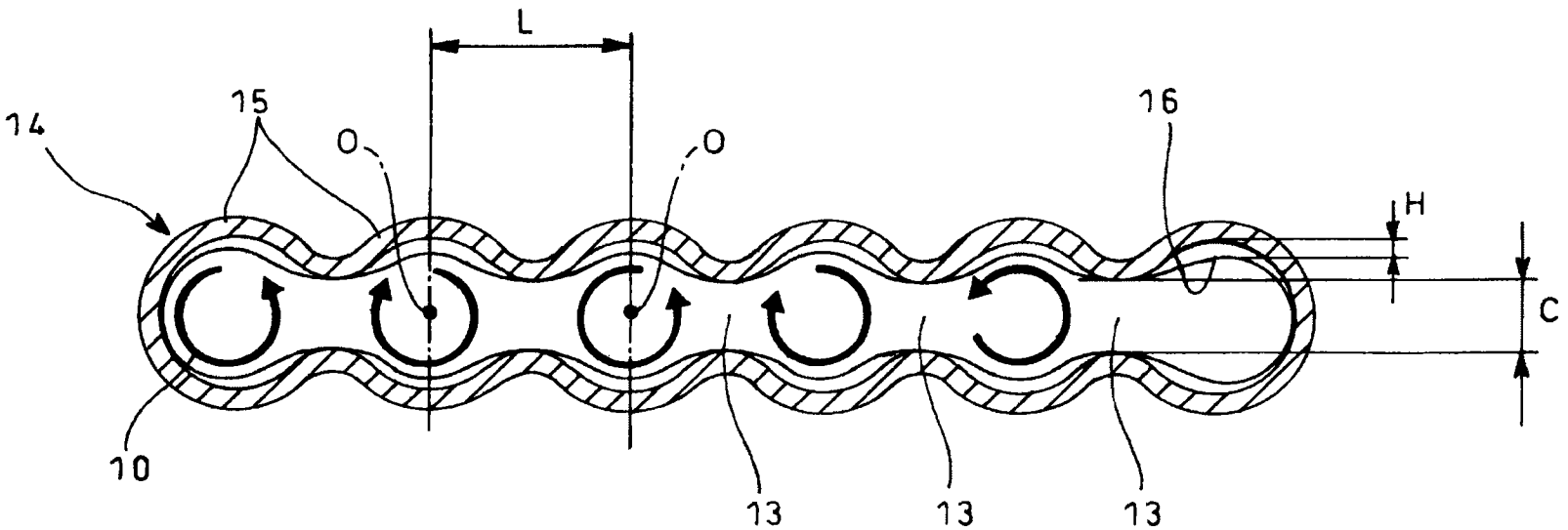
FIG. 5 is a sectional view of the flat tube body shown in FIG. 4.

FIGS. 4 and 5 show the embodiment of a heat exchanger tube according to the invention, which is applied to an EGR cooler as is the case in the above-mentioned prior art. In the figures, parts similar to those in FIGS. 1-3 are represented by the same reference numerals.

As shown in FIG. 4, the embodiment of the heat exchanger tube comprises a flat tube body 14 shaped like a plurality of cylindrical tubes arranged mutually proximally in a plane and connected together at mutually proximal portions thereof as communicating portions 13. Cylindrical portions 15 corresponding to the cylindrical tubes of the flat tube body 14 have inner peripheries formed with swirling-flow-forming protrusions 16 along spiral trajectories coaxial with central axes O of the cylindrical portions 15 (the respective cylindrical portions 15 are concaved into grooves on outer peripheries thereof to thereby provide swirling-flow-forming protrusions 16 as inverse formations) so that swirling flows of the exhaust gas 10 may be individually formed in respective cylindrical portions 15.

Specifically, as shown in FIG. 5, despite of the communicating portions 13 between the respective cylindrical portions 15, the exhaust gas 10 flowing through the respective cylindrical portions 15 is caused to swirl by properly tuning, for example, pitch L between central axes of the respective cylindrical portions 15, vertical gap C of the communicating portions 13 and raised height H of the swirling-flow-forming protrusions 16.

Especially in the embodiment, neighboring cylindrical portions 15 are shaped to have the swirling-flow-forming protrusions 16 directed along mutually reversed spiral trajectories (see appearances of the respective cylindrical portions 15 in FIG. 4) such that the swirling flows are orientated in one and the same direction at the communicating portions 13 of the neighboring cylindrical portions 15, which is a contrivance for prevention of mutual counteraction of the swirling flows (see directions of the swirling flows of the exhaust gas 10 shown by arrows in FIG. 5).

The flat tube body 14 may be produced by, for example, producing a pair of halved parts constituting upper and lower portions of the flat tube body through press working or the like, placing the halved parts one above the other and welding the parts at opposite ends thereof. Upon such press working, the respective cylindrical portions 15 may be concaved into grooves on outer peripheries thereof for prominence of the swirling-flow-forming protrusions 16 on the inner peripheries as inverse formations.

In such production of the flat tube body 14, various production methods may be, of course, utilized which have been already practiced for existing heat exchangers such as radiators and intercoolers. For example, parts to be joined may be formed to have overlap portions at which the parts are joined together through brazing; alternatively, a lower structure with an upper structure laid out sideways thereof may be pressed as a single piece, the upper structure being folded back on the lower structure and joined together through welding or brazing.

When sides or a side of the flat tube body 14 is to be utilized for joining, to form the swirling-flow-forming protrusions 16 (grooving on the outer periphery: see FIG. 4) on the sides or side may be partly omitted in view of easiness in a joining work. It has been affirmed by the inventors that the partial omission of the swirling-flow-forming protrusions 16 on the sides or side does not greatly affect the formation of the swirling flows.

Then, with the heat exchanger tube thus constituted, the flows of the exhaust gas 10 through the respective cylindrical portions 15 of the flat tube body 14 are guided in directions along the spiral trajectories by the swirling-flow-forming protrusions 16 on the inner peripheries of the respective cylindrical portions 15, so that the swirling flows of the exhaust gas 10 are individually formed in the respective cylindrical portions 15. As a result, the contact frequency and the contact distance of the exhaust gas 10 to the inner peripheries of the respective cylindrical portions 15 are increased to enhance the heat exchange efficiency. Moreover, the fact that the respective cylindrical portions 15 are mutually in communication through the communicating portions 13 ensures a sufficient flow-path cross-sectional area for passage of the exhaust gas 10, so that heat quantity exchanged per unit volume is enhanced and pressure loss is decreased.

In the embodiment, neighboring cylindrical portions 15 are shaped to have the swirling-flow-forming protrusions 16 directed along mutually reversed spiral trajectories, which makes the swirling flows, at the communicating portions 13 of the neighboring cylindrical portions 15, orientated in one and the same direction and mutually accelerated, so that, despite of the communicating portions 13 between the respective cylindrical portion 15, formation of the exhaust gas 10 as swirling flows can be further ensured.

Figure 6:
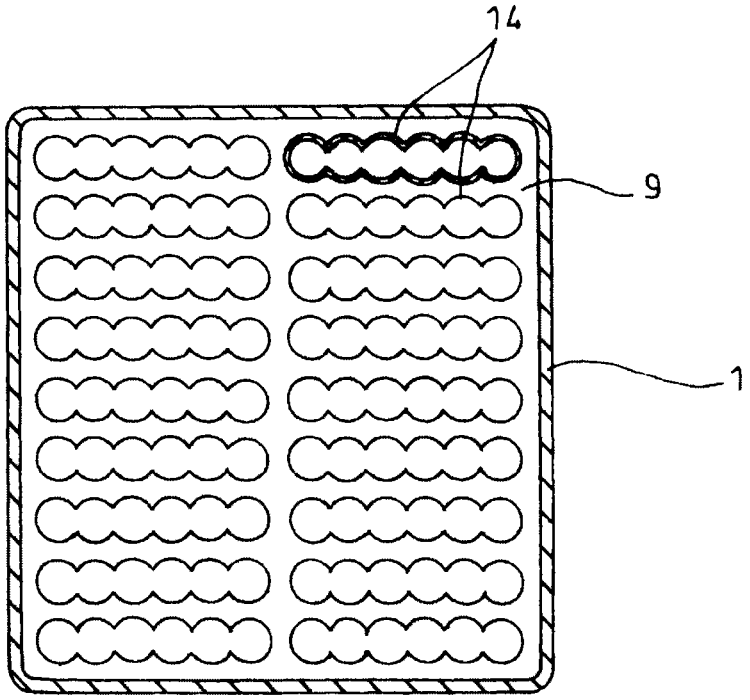
FIG. 6 is a sectional view schematically showing an application to an EGR cooler.

Thus, according to the above-mentioned embodiment, while the exhaust gas 10 is caused to swirl to thereby realize high heat exchange efficiency competing to the prior art, heat quantity exchanged per unit volume can be substantially enhanced to an extent unattainable in the prior art. For example, in an application to an EGR cooler as shown in FIG. 6, accommodated in the shell 1 with rectangular cross-section are the flat tube bodies 14 as mentioned in the above in a plurality of rows (two rows in the example illustrated) and in a multistage (nine stages in the example illustrated), so that the EGR cooler as a whole can be made compact in size to enhance mountability to a vehicle while an amount of the exhaust gas 10 to be recirculated can be increased more than ever to enhance the EGR ratio.

Especially in the embodiment, neighboring cylindrical portion 15 are shaped to have the swirling-flow-forming protrusions 16 directed along mutually reversed spiral trajectories, which makes the swirling flows, at the communicating portions 13 of the neighboring cylindrical portions 15, orientated in one and the same direction and mutually accelerated, so that formation of the swirling flows in the respective cylindrical portions 15 can be further ensured.

It is to be understood that a heat exchanger tube according to the invention is not limited to the above embodiment and that various changes and modifications may be made without departing from the scope of the invention. For example, the invention may be applied to any heat exchanger other than that for an EGR cooler.

REFERENCE SIGNS LIST

10 exhaust gas (heat medium)
13 communicating portions
14 flat tube body
15 cylindrical portion
16 swirling-flow-forming protrusion

The invention claimed is:

1. A heat exchanger tube comprising:

a flat tube body shaped like a plurality of cylindrical tubes arranged mutually proximately along a plane and connected together at mutually proximate portions of the cylindrical tubes as communicating portions; and cylindrical portions corresponding respectively to the cylindrical tubes of the flat tube body, the cylindrical portions being concaved into grooves on outer peripheries of the cylindrical portions to thereby provide swirling-flow-forming protrusions on inner peripheries of the cylindrical portions along spiral trajectories coaxial with central axes of the cylindrical portions so that swirling flows of heat medium may be individually formed in the respective cylindrical portions, wherein each of the cylindrical portions has a circular cross-section, wherein neighboring cylindrical portions are shaped to have the swirling-flow-forming protrusions directed along mutually reversed spiral trajectories, and wherein each of the grooves is formed to extend less than 180 degrees around a periphery of the circular cross-section of each of the cylindrical portions.

2. A heat exchanger tube comprising:

a flat tube body shaped like a plurality of cylindrical tubes arranged mutually proximately along a plane and connected together at mutually proximate portions of the cylindrical tubes as communicating portions; and cylindrical portions corresponding respectively to the cylindrical tubes of the flat tube body, the cylindrical portions including concave grooves on outer peripheries of the cylindrical portions to thereby provide swirling-flow-forming protrusions on inner peripheries of the cylindrical portions along spiral trajectories coaxial with central axes of the cylindrical portions so that swirling flows of heat medium may be individually formed in the respective cylindrical portions, wherein each of the cylindrical portion has a circular cross-section, wherein each of the grooves is formed to extend less than 180 degrees around a periphery of the circular cross-section of each of the cylindrical portions, wherein the grooves on adjacent cylindrical portions are slanted with respect to a longitudinal axis of the tube body in opposite directions so that the swirling flows of the heat medium of adjacent cylindrical portions swirl in opposite directions, and wherein the swirling flows are guided by the grooves only along the inner peripheries of the cylindrical portions where the grooves are formed.

3. The heat exchanger tube of claim 1, wherein the swirling flows are guided by the grooves only along the inner peripheries of the cylindrical portions where the grooves are formed.

* * * * *